US012128939B2

(12) United States Patent
Clauer et al.

(10) Patent No.: US 12,128,939 B2
(45) Date of Patent: Oct. 29, 2024

(54) DETECTING THE MOVEMENT OF A RAIL VEHICLE

(71) Applicant: Bayerische Motoren Werke Aktiengesellschaft, Munich (DE)

(72) Inventors: Dana Clauer, Munich (DE); Thomas Irrenhauser, Munich (DE); Marco Prueglmeier, Munich (DE); Philipp Wuddi, Oberschneiding (DE)

(73) Assignee: Bayerische Motoren Werke Aktiengesellschaft, Munich (DE)

( * ) Notice: Subject to any disclaimer, the term of this patent is extended or adjusted under 35 U.S.C. 154(b) by 796 days.

(21) Appl. No.: 17/298,351

(22) PCT Filed: Nov. 28, 2019

(86) PCT No.: PCT/EP2019/082994
§ 371 (c)(1),
(2) Date: May 28, 2021

(87) PCT Pub. No.: WO2020/109517
PCT Pub. Date: Jun. 4, 2020

(65) Prior Publication Data

US 2022/0111879 A1 Apr. 14, 2022

(30) Foreign Application Priority Data

Nov. 30, 2018 (DE) ..... 10 2018 130 590.7
Nov. 4, 2019 (DE) ..... 10 2019 129 663.3

(51) Int. Cl.
*B61L 29/30* (2006.01)
*B61L 1/16* (2006.01)
(Continued)

(52) U.S. Cl.
CPC ..... *B61L 29/228* (2013.01); *B61L 1/161* (2013.01); *B61L 29/28* (2013.01); *B61L 29/30* (2013.01); *B61L 1/16* (2013.01)

(58) Field of Classification Search
CPC .... B61L 1/16; B61L 1/165; B61L 29/08–228; B61L 29/284; B61L 29/28; B61L 29/30
See application file for complete search history.

(56) References Cited

U.S. PATENT DOCUMENTS 7,196,636 B2 * 3/2007 Graham ..... B61L 29/28 246/473 R
10,665,118 B2 * 5/2020 Hilleary ..... B61L 29/30
(Continued)

FOREIGN PATENT DOCUMENTS

DE 26 43 425 B1 1/1978
EP 3 275 764 A1 1/2018
(Continued)

OTHER PUBLICATIONS

International Search Report (PCT/ISA/210) issued in PCT Application No. PCT/EP2019/082944 dated Feb. 28, 2020 with English translation (four (4) pages).
(Continued)

*Primary Examiner* — Zachary L Kuhfuss
(74) *Attorney, Agent, or Firm* — Crowell & Moring LLP

(57) ABSTRACT

A method for detecting a movement of a rail vehicle, in particular a freight or passenger train, in a warning zone of a rail crossing, includes: determining a first temperature in the warning zone of the rail crossing or in a portion of the warning zone at a first time; determining a second temperature in the warning zone of the rail crossing or in a portion of the warning zone at a second time. The first time is chronologically before the second time. The method compares the first temperature with the second temperature. If the comparison demonstrates that the second temperature is
(Continued)

higher than the first temperature, the method outputs a warning signal and initiates blocking of the rail crossing.

14 Claims, 5 Drawing Sheets

(51) Int. Cl.
*B61L 29/22* (2006.01)
*B61L 29/28* (2006.01)

(56) References Cited

U.S. PATENT DOCUMENTS 10,850,756 B2 * 12/2020 Hilleary ..... G01S 13/62
10,967,894 B2 * 4/2021 Hilleary ..... B61L 29/30
2008/0073466 A1 * 3/2008 Mardirossian ..... B61L 29/30
246/125
2013/0015297 A1 * 1/2013 Steffen, II ..... B61L 29/22
246/125
2013/0194423 A1 * 8/2013 Baines ..... B61L 23/00
348/148
2013/0256466 A1 * 10/2013 Carlson ..... B61L 27/53
246/218
2014/0339374 A1 * 11/2014 Mian ..... B61L 29/30
246/473.1
2016/0189552 A1 * 6/2016 Hilleary ..... B61L 29/22
246/125
2019/0077429 A1 * 3/2019 D'Amico ..... B61L 23/041

FOREIGN PATENT DOCUMENTS

JP 2010-137677 A 6/2010
KR 10-0661264 B1 12/2006

OTHER PUBLICATIONS

German-language Written Opinion (PCT/ISA/237) issued in PCT Application No. PCT/EP2019/082944 dated Feb. 28, 2020 (five (5) pages).
German-language Search Report issued in German Application No. 10 2019 129 663.3 dated Jun. 10, 2020 with an English translation (10 pages).

* cited by examiner

DETECTING THE MOVEMENT OF A RAIL VEHICLE

BACKGROUND AND SUMMARY OF THE INVENTION

The invention relates in particular to a method for detecting the movement of a rail vehicle, in particular a freight train or passenger train, in the warning zone of a rail crossing.

When rails and roads intersect, safety measures are provided to prevent severe accidents. These are generally light signals and frequently also barriers which are lowered while a train travels through. These barriers receive the signal to be lowered either from a railway worker or from a sensor which recognizes a train.

Various types of sensors are capable of recognizing a train and emitting a corresponding signal. To achieve the shortest closing times of the rail crossing, the so-called axle counter has become widespread, cf. DE 26 43 425 B 1.

The surroundings or the regions of a rail crossing are typically divided into different zones. A train comes—independently of the travel direction—from the so-called harmless zone and travels into the so-called warning zone. Upon reaching the warning zone, the rail crossing receives a signal and closes the barrier. At the transition point between the harmless zone and the warning zone, a sensor registers the axle pattern of the train and the number of axles of the train. The train travels through the warning zone, which is adjoined at its end by the so-called protective zone. The protective zone is located shortly before and shortly after the intersection point between track and road, the actual rail crossing. After traversing the intersection point or the actual rail crossing, the train travels from the protective zone into the adjoining further warning zone. The further harmless zone adjoins the further warning zone. At the transition between the further or second warning zone and the further or second harmless zone, a further, second sensor also registers the axle pattern during the exit into the harmless zone. If the last axle of the train travels over the second sensor, the rail crossing is released and the barrier opens.

This known system can determine the points in time for opening and closing the rail crossing sufficiently accurately to obstruct the flow of traffic as briefly as possible.

However, there are structurally and operationally related special cases in which the known system does not function optimally, in particular if the loading and unloading of a train or of its cars is necessary on a factory site.

In such special cases, the train stops within the warning zone of the rail crossing and the cars are sometimes recoupled, maneuvered, or parked for maintenance. These intersections are currently traveled by sight by forklift drivers and other factory employees.

Autonomous vehicles which cannot be driven by sight cannot be used at such rail crossings. If the known system having axle counters were used, the closing times would be very long, because the barrier does not open again when the train is in the warning zone. The barrier only opens again when the train leaves the warning zone.

There is therefore a need for an improved, in particular more flexible method for securing a rail crossing.

The object of the invention is in particular to provide a method in which the road of a rail crossing is only briefly secured when it is actually necessary.

This object is achieved in particular by a method according to the independent claim. Advantageous embodiments of the invention are the subject matter of the dependent claims.

The invention starts from a method for detecting the movement of a rail vehicle, in particular a freight train or passenger train, in the warning zone of a rail crossing.

The following steps are provided according to the invention:

- the temperature in the warning zone of the rail crossing or in a section of the warning zone is determined at a first time,
- the temperature in the warning zone of the rail crossing or in a section of the warning zone is determined at a later second time,
- the temperature at the first time is compared to the temperature at the second time,
- if the comparison shows that the temperature at the later second time is higher than at the first time, a warning signal is output by a rail crossing safety device, and
- the rail crossing safety device causes the blocking of the rail crossing by a blocking message and/or a physical block.

The method according to the invention enables in particular shorter closing times in the cases in which a train has to stop in the warning zone. The departure of the train is reliably recognized and not only, for example, the entry into the protective zone. The barriers of the rail crossing are only closed if actually necessary and moreover even early. A significantly higher traffic flow via the road of the rail crossing is achieved.

According to one embodiment of the method according to the invention, it is provided that the determination of the temperature at the first time is only performed after a predetermined first time period after the entry of the rail vehicle into the warning zone.

In this way, the method according to the invention is only used when it is also actually necessary, namely during a longer stay of the train in the warning zone.

In one embodiment of the method according to the invention, it is provided that the rail crossing safety device causes the cancellation of the block of the rail crossing when the rail vehicle stays in the warning zone longer than a predetermined second time period after its entry into the warning zone.

This measure enables it to be able to release the rail crossing again rapidly if it is recognizable that the train has a longer stay in the warning zone.

According to one embodiment of the method according to the invention, it is provided that the rail crossing safety device receives the number of axles of the rail vehicle determined by the first axle counter during the entry into the warning zone. The rail crossing safety device receives the number of axles of the rail crossing determined by a second axle counter during the exit from the warning zone, and the rail crossing safety device compares the numbers of axles determined by the first and second axle counters to one another. The rail crossing safety device stores the number of axles determined by the second axle counter if the second number of axles differs from the first number of axles.

It may be recognized on the basis of this measure according to the invention that the number of axles of the train has changed, in particular if one or more cars have been coupled and/or uncoupled in the warning zone. In this way, false alarms due to different numbers of axles during the entry and exit can be prevented.

According to one preferred embodiment of the method according to the invention, it is provided that the determination of the first and the second temperature is performed by one or more heat or temperature registration devices, which are arranged along the warning zone of the rail crossing, preferably in a stationary manner.

These measures enable a substantially continuous registration of the departure of a train in the warning zone.

In one embodiment of the method according to the invention, it is provided that the comparison of the temperature at the first time to the temperature at the second time is performed on the basis of the temperature measurement by the same heat registration device.

In this way, measurement errors due to measurements at different points are avoided. However, it can be expedient to relay its measured values from one heat registration device to the next heat registration device or one or more further heat registration devices.

According to one preferred embodiment of the method according to the invention, it is provided that the at least one heat registration device or at least one temperature measurement device is formed by a thermal imaging camera and/or an infrared sensor.

By using a thermal imaging camera as a heat registration device, the reliability of the method according to the invention for recognizing a departing train is further increased.

According to one preferred embodiment of the method according to the invention, it is provided that at the first and the second time, the exhaust gas temperature of the rail vehicle is measured for the temperature comparison, in particular for a diesel locomotive.

This measure according to the invention is also capable of further significantly increasing the reliability of the method according to the invention for recognizing a departing train.

According to one preferred embodiment of the method according to the invention, it is provided that the method includes transmitting the stored number of axles to a further track section.

In this way, the advantage is achieved that further track sections can be informed accordingly about the length of the train or rail vehicle, so that these further track sections, for example a further rail crossing or a factory exit, can be informed about the track length and thus about a blockage duration.

Moreover, the invention proposes a rail crossing safety device for detecting the movement of a rail vehicle in the warning zone of a rail crossing. The rail crossing safety device is advantageously distinguished by the execution of a method according to the invention.

Furthermore, the invention proposes a rail crossing having a rail crossing safety device for detecting the movement of a rail vehicle in the warning zone of a rail crossing. The rail crossing is also advantageously distinguished by the execution of a method according to the invention.

Finally, the invention proposes a computer program product for controlling at least one processor which effectuates the execution of at least one step of a method according to the invention.

The invention is explained in greater detail hereinafter on the basis of the figures.

DETAILED DESCRIPTION OF THE DRAWINGS

Figure 1:
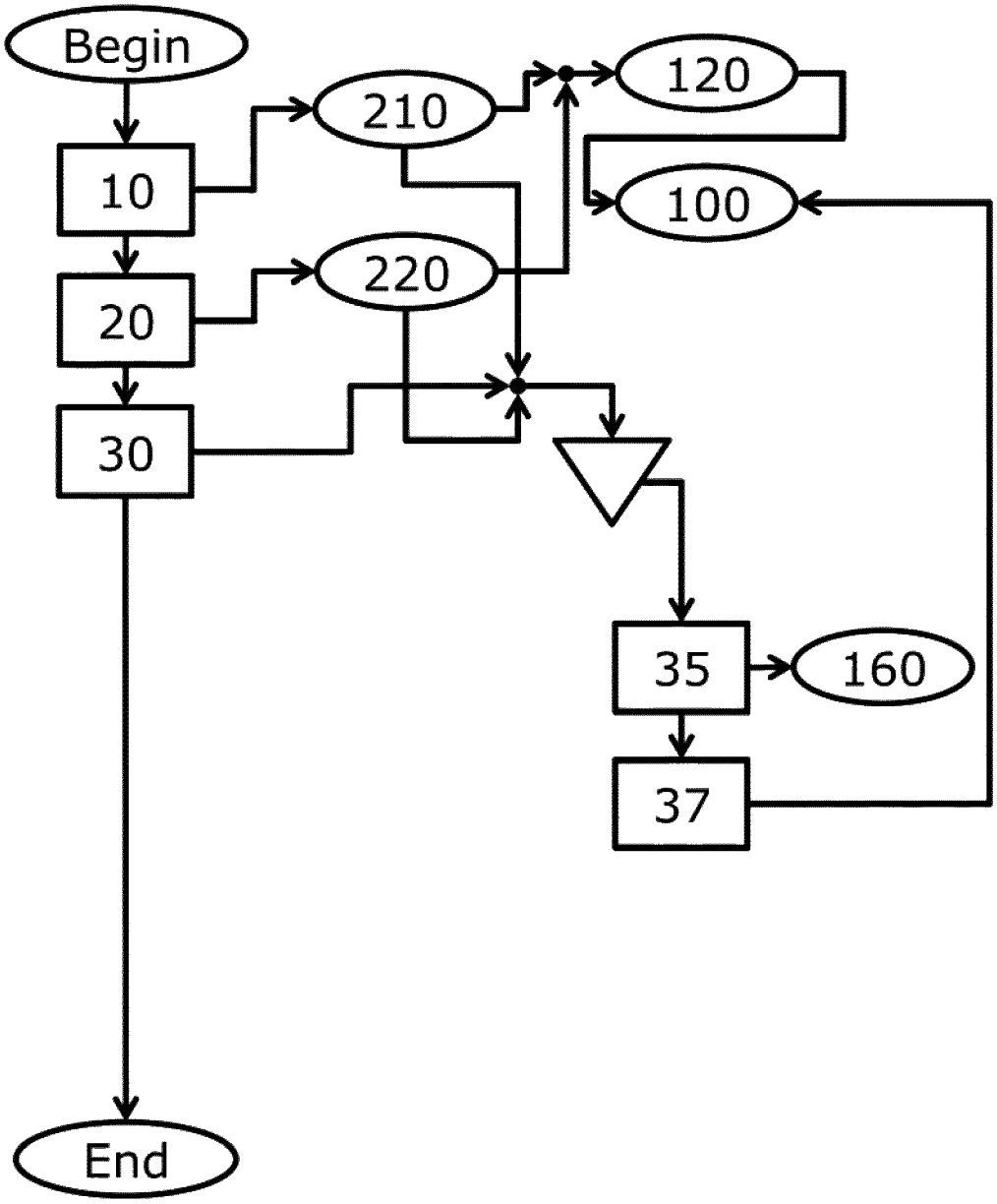
FIG. 1 shows a schematic illustration of a proposed method according to one exemplary embodiment of the invention.

FIG. 1 shows a schematic illustration of a proposed method according to one exemplary embodiment of the invention.

FIG. 1 shows a schematic illustration of a method for detecting a movement of a rail vehicle, in particular a freight train or passenger train, in a warning zone 120 of a rail crossing 100, characterized in that the method comprises: determining 10 a first temperature 210 in the warning zone 120 of the rail crossing 100 or in a section of the warning zone 120 at a first time. Determining 20 a second temperature 220 in the warning zone 120 of the rail crossing 100 or in a section of the warning zone 120 at a second time. The first time is chronologically before the second time. Comparing 30 the first temperature 210 to the second temperature 220. If the comparison shows that the second temperature 220 is higher than the first temperature 210, the method comprises outputting 35 a warning signal 160 and initiating 37 a block of the rail crossing 100.

For example, the determination of the first temperature 210 at the first time can only be performed after a predetermined first time period after the entry of the rail vehicle into the warning zone 120.

This can have the advantage that relevance of the measurement results can be increased. The advantage can thus result that the reliability of the method or of the rail crossing safety device can be increased.

Figure 2:
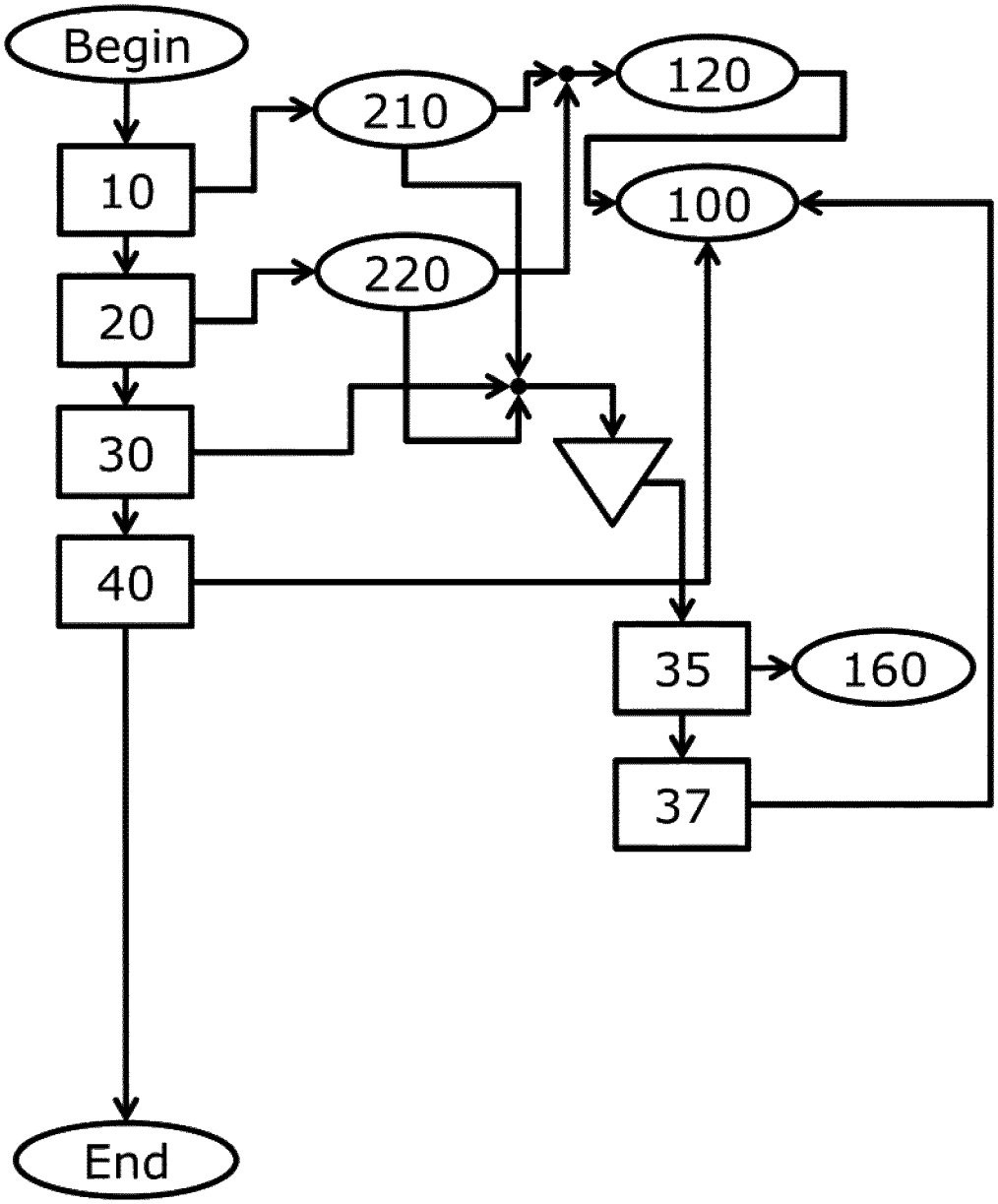
FIG. 2 shows a schematic illustration of a proposed embodiment according to a further exemplary embodiment of the invention.

FIG. 2 shows a schematic illustration of a proposed method according to a further exemplary embodiment of the invention.

FIG. 2 shows a schematic illustration of the method, wherein the method furthermore comprises: initiating 40 a cancellation of the block of the rail crossing 100 if the rail vehicle stays in the warning zone 120 longer than a predetermined second time period after its entry into the warning zone 120.

Figure 3:
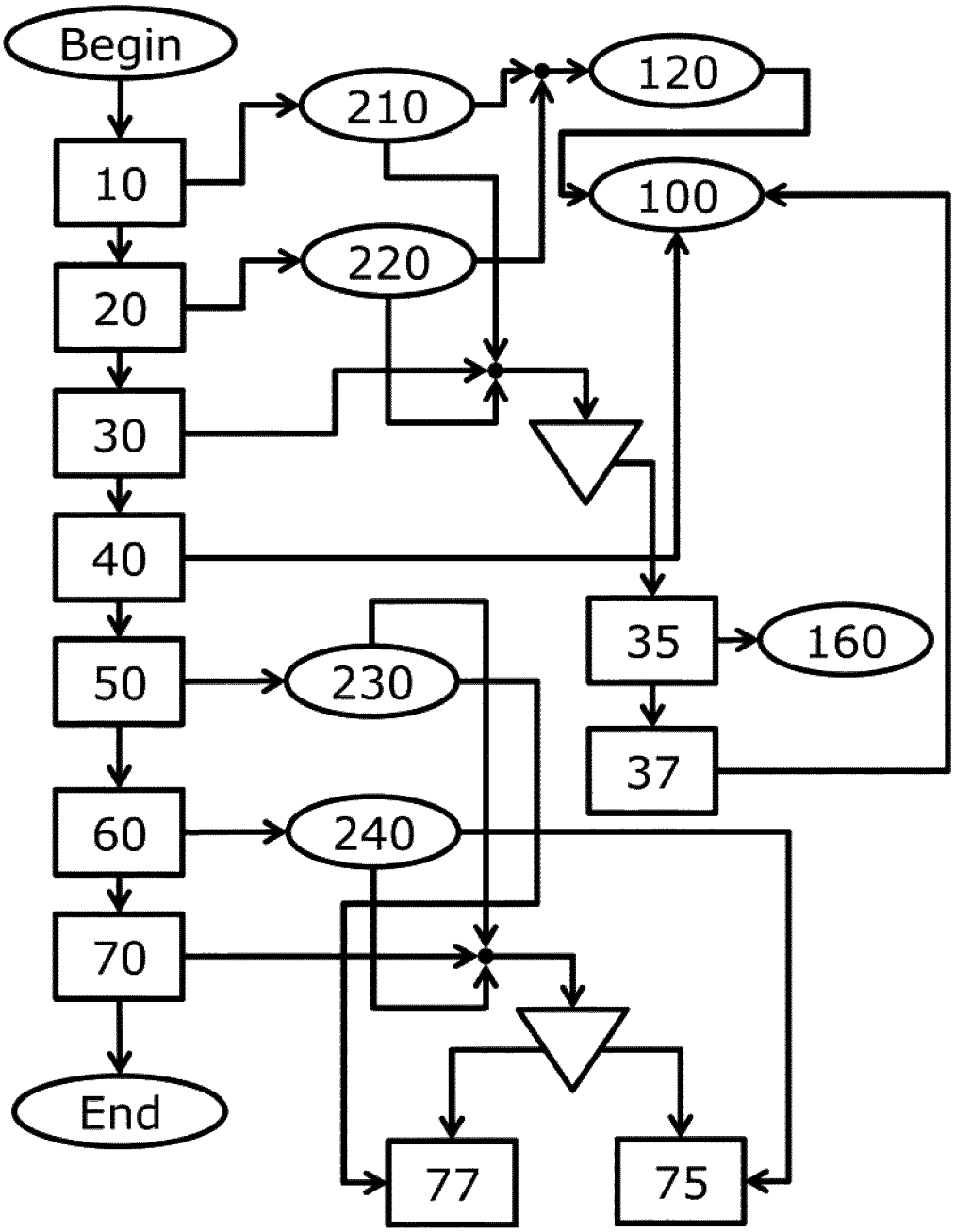
FIG. 3 shows a schematic illustration of a proposed method according to a further exemplary embodiment of the invention.

FIG. 3 shows a schematic illustration of a proposed method according to a further exemplary embodiment of the invention.

FIG. 3 shows a schematic illustration of the method, wherein the method furthermore comprises: determining 50 a first number of axles 230 during an entry of the rail vehicle into the warning zone 120. Determining 60 a second number of axles 240 during an exit of the rail vehicle from the warning zone 120. Comparing 70 the first and the second number of axles 230, 240 to one another. And if the second number of axles 240 differs from the first number of axles 230: storing 75 the second number of axles 240. And if the second number of axles 240 does not differ from the first number of axles 230: storing 77 the first number of axles 230.

For example, the initiation 37 of the block of the rail crossing 100 and/or a chronological duration of the predetermined second time period can be produced based on the stored number of axles 230, 240.

This can have the advantage that the block of the rail crossing 100 can be performed more effectively, the duration of the block can thus be selected more adequately.

FIGS. 1 to 3 share the following exemplary embodiments.

For example, the determination of the first and second temperature 210, 220 can be performed by one or more heat or temperature registration devices which are arranged, preferably in a stationary manner, along the warning zone 120 of the rail crossing 100.

This can have the advantage that devices especially provided for such measurements can be used for the temperature registration. Costs can thus be reduced. Furthermore, the reliability of the method or of the rail crossing safety device can thus be increased.

For example, the comparison 30 of the temperature 210 at the first time to the temperature 220 at the second time can be performed on the basis of the temperature measurement by the same heat registration device.

This can have the advantage that the reliability of the method or of the rail crossing safety device can thus be further increased. This is because, for example, error tolerances in the temperature measurement can thus be minimized or even eliminated.

For example, the at least one heat registration device or at least one temperature measuring device can be formed by a thermal imaging camera and/or an infrared sensor.

This can have the advantage that routine devices for temperature registration can be used. Costs can thus be reduced. Furthermore, the reliability of the method or of the rail crossing safety device can thus also be increased.

For example, at the first and the second time, the exhaust gas temperature of the rail vehicle can be measured for the temperature comparison 30, wherein the rail vehicle in particular comprises a diesel locomotive.

In the case in which the rail vehicle comprises a diesel locomotive, the second temperature can be indicative that departure of the rail vehicle is imminent. In this case, it can be presumed that the rail vehicle will begin to travel soon—or also in a predetermined time period—and leave the warning zone.

This can have the advantage that the reliability of the method or of the rail crossing safety device is thus increased.

For example, the output 35 of the warning signal and the initiation 37 of the block of the rail crossing 100 can take place if the comparison 30 shows that the second temperature 220 is higher by a threshold value than the first temperature 210. Such a threshold value can have the advantage that small temperature differences which are not indicative that a departure of the rail vehicle is imminent can be neglected and the reliability of the block of the rail crossing can thus be still further increased. The threshold value can be specified here. The threshold value can additionally also be individually dependent on the rail vehicle. For example, the threshold value can be dependent on the type of the locomotive of the rail vehicle.

For example, the initiation 37 of the block of the rail crossing 100 can take place physically and/or virtually.

A physical block of the rail crossing 100 can have the advantage that a more secure block of the rail crossing can be produced.

A virtual block of the rail crossing 100 can have the advantage that the block can be performed cost-effectively in that the virtual block can be transmitted, for example, as blocking information to internal-system devices of autonomous motor vehicles. The costs of a physical block can thus be avoided. This can be carried out without significantly negatively influencing the reliability of the rail crossing block.

If both types of block are used in parallel to one another, the reliability of the rail crossing block can thus be increased still further. This can be provided, for example, in that a redundancy of the block of the rail crossing 100 is thus present.

For example, the initiation 37 of the block of the rail crossing 100 can be carried out by means of a light signal, a rail barrier, and/or an item of blocking information to a vehicle located in a vicinity of the rail crossing 100.

The blocking information can thus be transmitted to a motor vehicle or a computer device of the motor vehicle. This can be carried out, for example, by means of wireless communication, for example by means of UMTS, WLAN, 4G, 5G, MANET, VANET, Car2X, and the like.

The block of the rail crossing 100 by means of light signals or rail barriers can have the advantage that routine devices for blocking the rail crossing 100 can be used. Costs can thus be lowered. Furthermore, the reliability of the method or the rail crossing safety device can thus also be increased.

The block of the rail crossing 100 by means of an item of blocking information can have the advantage that autonomously driving motor vehicles can be controlled effectively and safely without requiring a more costly physical rail barrier.

FIG. 4 shows a schematic illustration of a proposed device according to a further exemplary embodiment of the invention.

FIG. 4 shows a schematic illustration of a rail crossing safety device for detecting a movement of a rail vehicle in a warning zone 120 of a rail crossing 100. The rail crossing safety device is configured to execute a method according to the invention.

Figure 4A:
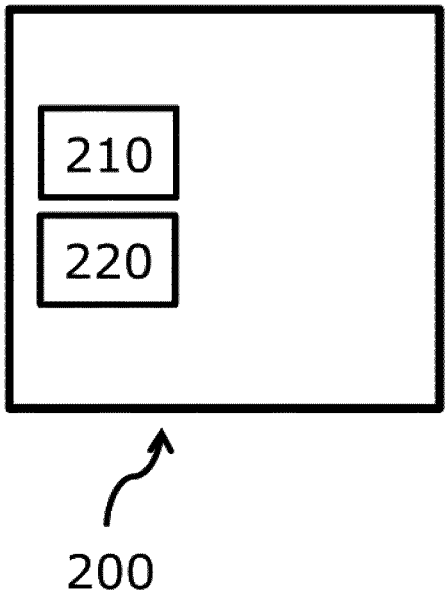
FIG. 4 shows a schematic illustration of a proposed device according to a further exemplary embodiment of the invention.

In FIG. 4*a*, the rail crossing safety device 200 only comprises the heat or temperature registration device(s) for measuring the first temperature 210 and the second temperature 200. One or also multiple temperature registration devices can be used here for measuring the two temperatures.

Figure 4B:
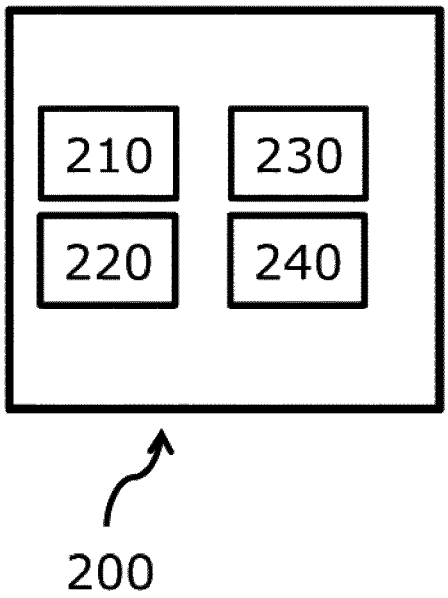

In FIG. 4*b*, in contrast, the rail crossing safety device 200 comprises both the heat or temperature registration device(s) for measuring the first temperature 210 and the second temperature 200, and also the device(s) for measuring the first number of axles 230 and the second number of axles 240. One or also multiple number of axle registration devices can be used here for measuring the two numbers of axles.

Figure 5:
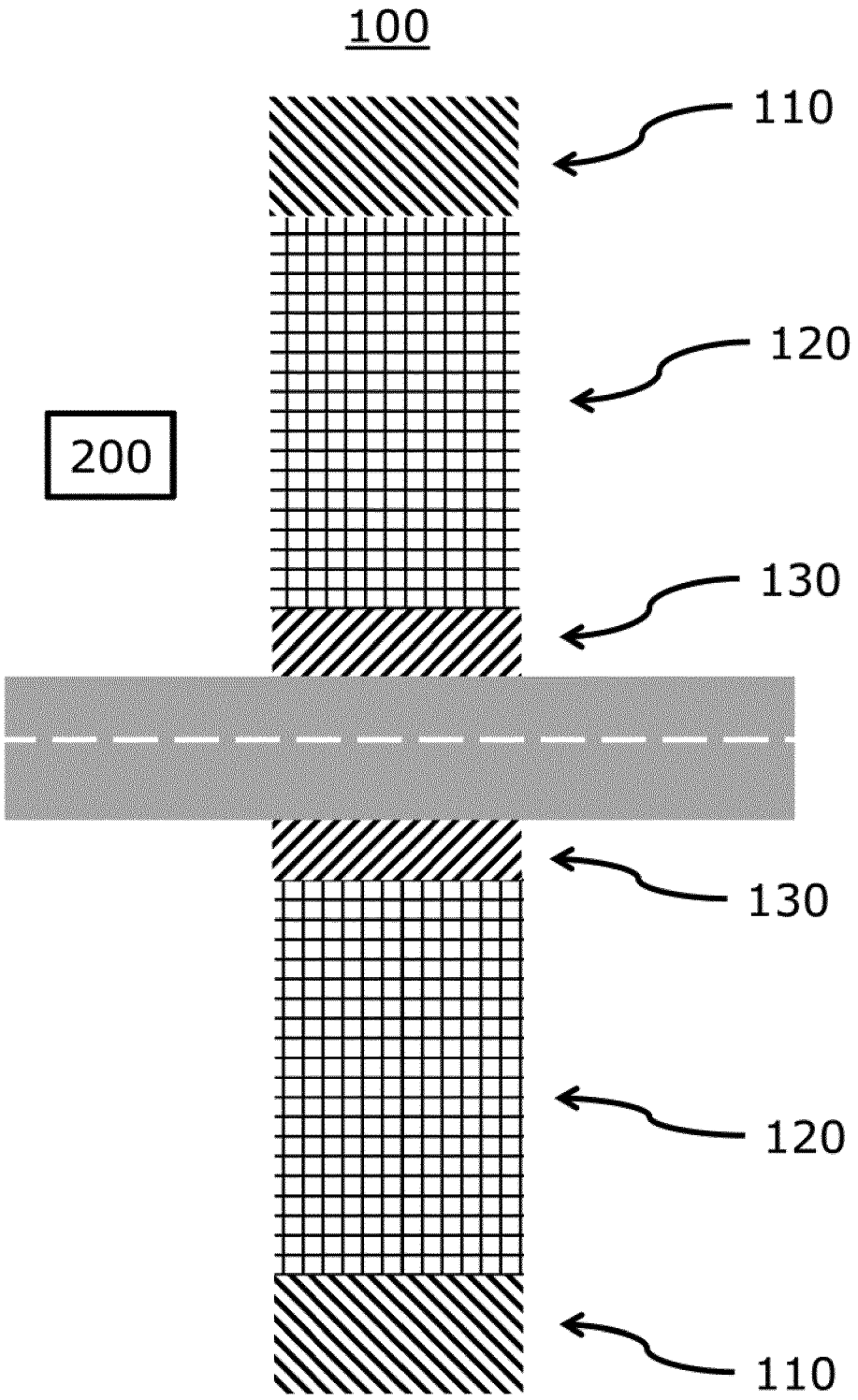
FIG. 5 shows a schematic illustration of a proposed rail crossing according to a further exemplary embodiment of the invention.

FIG. 5 shows a schematic illustration of a proposed rail crossing according to a further exemplary embodiment of the invention.

FIG. 5 shows a schematic illustration of a rail crossing having a rail crossing safety device for detecting a movement of a rail vehicle in a warning zone 120 of a rail crossing 100. The rail crossing is configured to execute a method according to the invention.

LIST OF REFERENCE NUMERALS

10 determining the first temperature
20 determining the second temperature
30 comparing the first temperature to the second temperature
35 outputting the warning signal
37 initiating the block of the rail crossing

40 initiating the cancellation of the block of the rail crossing
50 determining the first number of axles of the rail vehicle
60 determining the second number of axles of the rail vehicle
70 comparing the first number of axles to the second number of axles
75 storing the first number of axles
77 storing the second number of axles
100 rail crossing
110 harmless zone
120 warning zone
130 protective zone
160 warning signal
200 rail crossing safety device
210 first temperature
220 second temperature
230 first number of axles
240 second number of axles

What is claimed is:

1. A method for detecting a movement of a rail vehicle in a warning zone of a rail crossing, the method comprising the acts of:

determining a first temperature in the warning zone of the rail crossing or in a section of the warning zone at a first time;

determining a second temperature in the warning zone of the rail crossing or in a section of the warning zone at a second time, wherein the first time is chronologically before the second time;

comparing the first temperature to the second temperature; and when the comparison shows that the second temperature is higher than the first temperature;

outputting a warning signal, and initiating a block of the rail crossing, wherein the determination of the first temperature at the first time is only performed after a predetermined first time period after entry of the rail vehicle into the warning zone.

2. The method for detecting the movement of a rail vehicle in the warning zone of a rail crossing according to claim 1, the method further comprising the act of:

initiating a cancellation of the block of the rail crossing when the rail vehicle stays in the warning zone longer than a predetermined second time period after its entry into the warning zone.

3. The method for detecting the movement of a rail vehicle in the warning zone of a rail crossing according to claim 1, the method further comprising the acts of:

determining a first number of axles during an entry of the rail vehicle into the warning zone;

determining a second number of axles during an exit of the rail vehicle from the warning zone; and comparing the first and the second number of axles to one another; and when the second number of axles differs from the first number of axles;

storing the second number of axles, otherwise storing the first number of axles.

4. The method for detecting a rail vehicle in the warning zone of a rail crossing according to claim 3, wherein the initiation of the block of the rail crossing and/or a chronological duration of the predetermined second time period is produced based on the stored number of axles.

5. The method for detecting the movement of a rail vehicle in the warning zone of a rail crossing according to claim 1, wherein the determination of the first and the second temperature is performed by one or more heat or temperature registration devices which are arranged, in a stationary manner, along the warning zone of the rail crossing.

6. The method for detecting the movement of a rail vehicle in the warning zone of a rail crossing according to claim 5, wherein the comparison of the temperature at the first time to the temperature at the second time is performed on the basis of the temperature measurement by the same heat registration device.

7. The method for detecting the movement of a rail vehicle in the warning zone of a rail crossing according to claim 5, wherein the at least one heat registration device or at least one temperature measurement device is formed by a thermal imaging camera and/or an infrared sensor.

8. The method for detecting the movement of a rail vehicle in the warning zone of a rail crossing according to claim 1, wherein at the first and the second time, an exhaust gas temperature of the rail vehicle is measured for the temperature comparison, wherein the rail vehicle comprises a diesel locomotive.

9. The method for detecting the movement of a rail vehicle in the warning zone of a rail crossing according to claim 1, wherein the output of the warning signal and the initiation of the block of the rail crossing take place when the comparison shows that the second temperature is higher than the first temperature by a threshold value.

10. The method for detecting the movement of a rail vehicle in the warning zone of a rail crossing according to claim 1, wherein the initiation of the block of the rail crossing takes place physically and/or virtually.

11. The method for detecting the movement of a rail vehicle in the warning zone of a rail crossing according to claim 1, wherein the initiation of the block of the rail crossing is carried out by a light signal, a rail barrier, and/or an item of blocking information, to a motor vehicle located in a vicinity of the rail crossing.

12. The method for detecting the movement of a rail vehicle in the warning zone of a rail crossing according to claim 1, wherein the rail vehicle is a freight or passenger train.

13. A rail crossing safety system for detecting a movement of a rail vehicle in a warning zone of a rail crossing, wherein the system is configured to carry out the acts of:

determining a first temperature in the warning zone of the rail crossing or in a section of the warning zone at a first time;

determining a second temperature in the warning zone of the rail crossing or in a section of the warning zone at a second time, wherein the first time is chronologically before the second time;

comparing the first temperature to the second temperature; and when the comparison shows that the second temperature is higher than the first temperature;

outputting a warning signal, and initiating a block of the rail crossing, wherein the determination of the first temperature at the first time is only performed after a predetermined first time period after entry of the rail vehicle into the warning zone.

14. A computer product comprising a non-transitory computer-readable medium having stored thereon program code that, when executed by one or more processors, carries out the acts of:

determining a first temperature in the warning zone of the rail crossing or in a section of the warning zone at a first time;

determining a second temperature in the warning zone of the rail crossing or in a section of the warning zone at a second time, wherein the first time is chronologically before the second time;

comparing the first temperature to the second temperature; and when the comparison shows that the second temperature is higher than the first temperature;

outputting a warning signal, and initiating a block of the rail crossing, wherein the determination of the first temperature at the first time is only performed after a predetermined first time period after entry of the rail vehicle into the warning zone.

* * * * *